US008490810B2

(12) United States Patent
Lown

(10) Patent No.: US 8,490,810 B2
(45) Date of Patent: Jul. 23, 2013

(54) METHOD OF MERCHANDISING MODULAR HOME STORAGE CONTAINERS TO ALLOW CONSUMERS TO MAXIMIZE STORAGE SPACE

(75) Inventor: John M. Lown, Huntington Beach, CA (US)

(73) Assignee: Snapware Corporation, Mira Loma, CA (US)

( * ) Notice: Subject to any disclaimer, the term of this patent is extended or adjusted under 35 U.S.C. 154(b) by 1894 days.

(21) Appl. No.: 11/584,701

(22) Filed: Oct. 20, 2006

(65) Prior Publication Data

US 2008/0105630 A1 May 8, 2008

(51) Int. Cl.
*B65D 6/28* (2006.01)

(52) U.S. Cl.
USPC ..... 220/4.26; 220/4.27; 220/23.6; 206/501; 206/503; 206/509

(58) Field of Classification Search
USPC ..... 220/509, 4.26, 23.6, 23.2, 4.27, 380, 220/781; 206/501, 503; 211/188, 150
See application file for complete search history.

(56) References Cited

U.S. PATENT DOCUMENTS

| | | | | | |
|---|---|---|---|---|---|
| D23,079 | S | * | 2/1894 | Hermann | D6/474 |
| 1,745,164 | A | * | 1/1930 | Griffith | 108/23 |
| 1,909,223 | A | * | 5/1933 | Roos | 108/99 |
| 2,499,089 | A | * | 2/1950 | Brill et al. | 62/251 |
| 2,883,064 | A | * | 4/1959 | McKenzie | 108/99 |
| 3,061,136 | A | * | 10/1962 | Sterngart | 220/504 |
| 3,117,692 | A | * | 1/1964 | Carpenter et al. | 206/508 |
| 3,201,035 | A | * | 8/1965 | Martin et al. | 232/1 R |
| 3,331,529 | A | * | 7/1967 | Slapnik | 206/508 |
| 3,339,725 | A | | 9/1967 | Hamilton | |
| 3,369,375 | A | * | 2/1968 | Gerweck et al. | 62/256 |
| 3,375,953 | A | * | 4/1968 | Miller, Jr. | 206/506 |
| 3,498,494 | A | * | 3/1970 | Voorhees, Jr. | 206/501 |
| 3,719,408 | A | * | 3/1973 | Fullington et al. | 312/236 |
| 3,741,617 | A | * | 6/1973 | Gloyd | 312/108 |
| 3,811,559 | A | | 5/1974 | Carter | |
| 3,906,872 | A | * | 9/1975 | Erickson | 108/92 |
| 4,105,117 | A | * | 8/1978 | Atkin et al. | 206/501 |
| 4,139,098 | A | * | 2/1979 | Mollon | 206/507 |
| 4,372,444 | A | * | 2/1983 | Le Grand et al. | 206/505 |
| 4,573,577 | A | * | 3/1986 | Miller | 206/506 |
| 4,619,363 | A | * | 10/1986 | Wolfseder | 206/373 |
| 4,813,542 | A | * | 3/1989 | Thompson et al. | 206/504 |

(Continued)

OTHER PUBLICATIONS

Snapware Corporation—2005 sales guide brochure

*Primary Examiner* — Anthony Stashick
*Assistant Examiner* — Christopher McKinley
(74) *Attorney, Agent, or Firm* — Larry K. Roberts

(57) ABSTRACT

A method of merchandising a modular home storage container system includes providing a plurality of individual groups of containers adapted for use on standardized shelving. Each container has side walls extending upwardly from a bottom wall to an open top and a removable lid. The containers, in each group, have a uniform length which correlates with one of the shelving depths, a uniform width to provide a uniform footprint size to accommodate the use of a single size lid and a plurality of different heights to allow a consumer to optimize the use of the available shelf height space. The heights of the containers are graduated so that the overall height of two stacked shorter containers will approximate the height of a taller container. Preferably a chart correlating the lengths of the individual groups of containers with standard shelving depths is available at the display site.

13 Claims, 11 Drawing Sheets

U.S. PATENT DOCUMENTS 4,838,417 A * 6/1989 Jeruzal ..... 206/318
4,863,222 A * 9/1989 Posso ..... 312/107
4,871,217 A 10/1989 Taylor et al.
4,914,874 A * 4/1990 Graham, Jr. ..... 52/79.1
4,948,566 A * 8/1990 Gabele et al. ..... 422/107
5,147,044 A * 9/1992 DiSesa, Jr. ..... 206/501
5,277,486 A * 1/1994 Bustos ..... 312/125
5,502,979 A * 4/1996 Renard ..... 62/256
5,617,953 A * 4/1997 Cope ..... 206/501
6,273,258 B1 * 8/2001 Piacenza ..... 206/503
6,321,663 B1 * 11/2001 Rogers ..... 108/100
6,415,947 B1 7/2002 Kim
7,243,795 B2 * 7/2007 Gold et al. ..... 206/459.5
7,591,144 B2 * 9/2009 Wilson et al. ..... 62/251
7,721,891 B2 * 5/2010 Dubois ..... 206/507
7,726,483 B2 * 6/2010 Ramanujam et al. ..... 206/508
2006/0011626 A1 * 1/2006 Palder ..... 220/6
2006/0027578 A1 * 2/2006 Cadiente et al. ..... 220/23.88
2006/0201176 A1 * 9/2006 Wilson ..... 62/252
2006/0261023 A1 * 11/2006 Goth ..... 211/128.1

* cited by examiner

Container Grouping Size Chart

| Description | | Foot Print | Container Height | | | | | |
|---|---|---|---|---|---|---|---|---|
| Number | Series | Length and Width | $h_1$ - 2.5" | $h_2$ - 5" | $h_3$ - 7.5" | $h_4$ - 10" | $h_5$ - 12.5" | $h_6$ - 15" |
| 8 | Mini | 7.5" x 7.5" | | | | | | |
| 10 | Square | 9.5" x 9.5" | | | | | | |
| 12 | Small | 11.5" x 9.5" | | | | | | |
| 14 | Shoe Box | 13.5" x 9.5" | | | | | | |
| 16 | Medium | 15.5" x 11.5" | | | | | | |
| 18 | Large | 17.5" x 13.5" | | | | | | |
| 20 | Extra Large | 19.5" x 15.5" | | | | | | |

Figure 13

METHOD OF MERCHANDISING MODULAR HOME STORAGE CONTAINERS TO ALLOW CONSUMERS TO MAXIMIZE STORAGE SPACE

FIELD OF THE INVENTION

The present invention relates to home storage containers and more particularly to a merchandising method which enables consumers to select from groups or containers, those particular containers which best fit their available storage shelf space.

BACKGROUND OF THE INVENTION

Shelving, either stand alone or in a cabinet, available in households (including garages) for storing a variety of items and materials, generally conform to a group of standard depth dimensions, e.g., having depths of 8", 10", 12", 14", 18" and 20", with a variety of distances between adjacent shelves or heights from a lower to an upper shelf sometimes hereinafter referred to as shelf height space. Storage cabinets available in most home improvement stores include shelving having similar depths and shelf height spaces. A large variety of storage containers designed to be placed on shelves are available on the market. While such containers may fit on commonly available or standard shelves. As a general rule they do not optimize the use of the available shelf depth or height spacing. There has been no attempt to correlate the length or height of such containers with the standard shelving to enable a consumer to maximize his or her storage space.

There is a need for a user friendly modular storage system that will enable a home owner or renter to maximize the storage space available with standardized shelves.

SUMMARY OF THE INVENTION

To the above end, I have developed a method for allowing consumers to customize their available storage shelf space by providing a plurality of individual groups of empty storage containers designed to take advantage of the standard shelving depths and a variety of distances between adjacent shelves. Each container is in the form of a vessel having front, back and side walls extending upwardly from a bottom wall (preferably at an appropriate outwardly inclined draft angle to allow nesting and stacking) to a rim surrounding an open top and a removable lid or cover for closing the vessel.

The containers in each individual group have a uniform length which correlates with a standard shelving depth (e.g., slightly shorter to allow the closure of an associated cabinet door and/or accommodate a nailing flange), a uniform width (i.e., to provide a uniform footprint size to accommodate stacking and the use of a single sized lid) and a plurality of different heights (i.e., to allow the consumer to optimize the shelf height space. Preferably the heights of the containers are graduated so that the height of two or more shorter containers in a stacked condition will approximately be the height of a taller container. Preferably, the container rims extend outwardly from the upper end of at least two opposed walls to form convenient handles. In addition, latches are preferably pivotally mounted on the front and back walls of the container with the latches being arranged to snap over the lids to secure the contents within the container. Preferably information, e.g., in the form of a chart, is made available to prospective purchasers which correlate the lengths of the container groups with standard shelving depths along with available container heights.

The storage container merchandising method for aiding a customer to customize and maximize the use of his or her available storage space of the present invention may best be understood by reference to the following description taken in conjunction with the appended drawings.

BRIEF DESCRIPTION OF THE DRAWINGS

FIG. 13 is a chart correlating the above container groups' dimensions with standard shelving depths along with several different container heights.

DESCRIPTION OF THE PREFERRED EMBODIMENT

Figure 1:
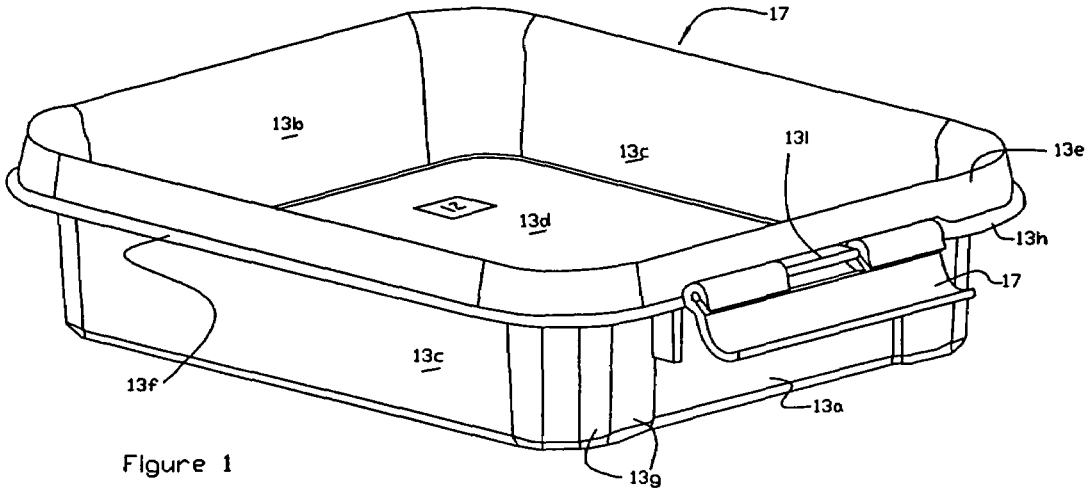
FIG. 1 is a perspective view of a typical vessel portion of a container without regard for size.
Figure 2:
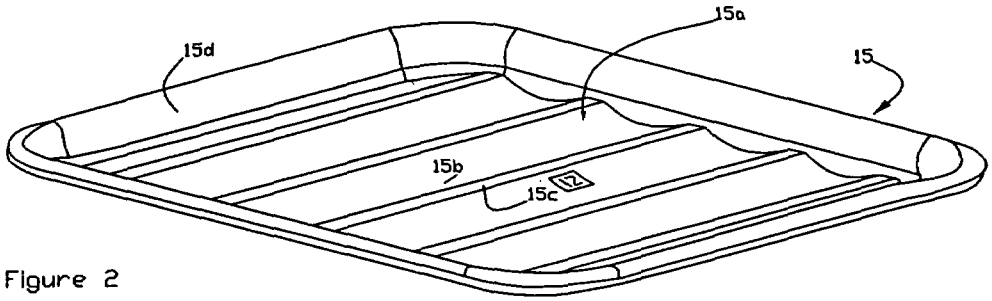
FIG. 2 is a perspective view of a typical lid, again without regard for size.
Figure 3:
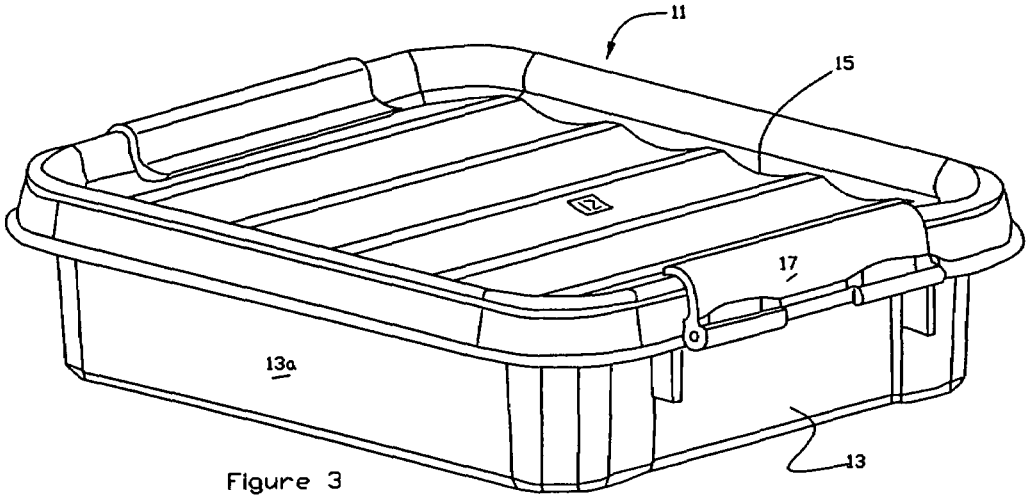
FIG. 3 is a perspective view of the container of FIGS. 1 and 2 in an assembled condition.

Referring now to the drawings and particularly to FIGS. 1-5 a container 11 includes a vessel 13 and a cover or lid 15. The vessel and lid are preferably molded of a suitable plastic material such as polypropylene. The vessel is formed with front, back and side walls 13*a*, 13*b* and 13*c*, respectively, extending upwardly and outwardly at a molding draft angle θ such as 5°. from a bottom wall 13*d* to rim 13*e* surrounding an open top. The rim extends outwardly from the side walls and downwardly as illustrated to form an inverted u-shaped handle section 13*f* to accommodate a user's fingers for lifting and transporting purposes. The corners are formed with vertically oriented panels 13*g* for strength and decorative purposes. Latches 17 are hinged to a free end 13*h* of the rim on the front and back walls via axles 13*i*. A symbol identifying each group footprint size is molded into the bottom of the container, which for illustrative purposes is shown as 12.

The lid 15 is formed with a depressed central section 15*a* with undulating valleys 15*b* and peaks 15*c* with the peaks lying in a horizontal plane to accommodate the bottom wall of a container of the same group, i.e, having the same footprint for stacking purposes. See FIGS. 6-12. The central section 15*a* merges with an upwardly extending peripheral section 15*d* which mates with the vessel's rim 13*e* for closing the vessel. A symbol correlating the lid with a particular container group is molded into the lid, which for illustrative purposes is shown as 12.

Figure 4:
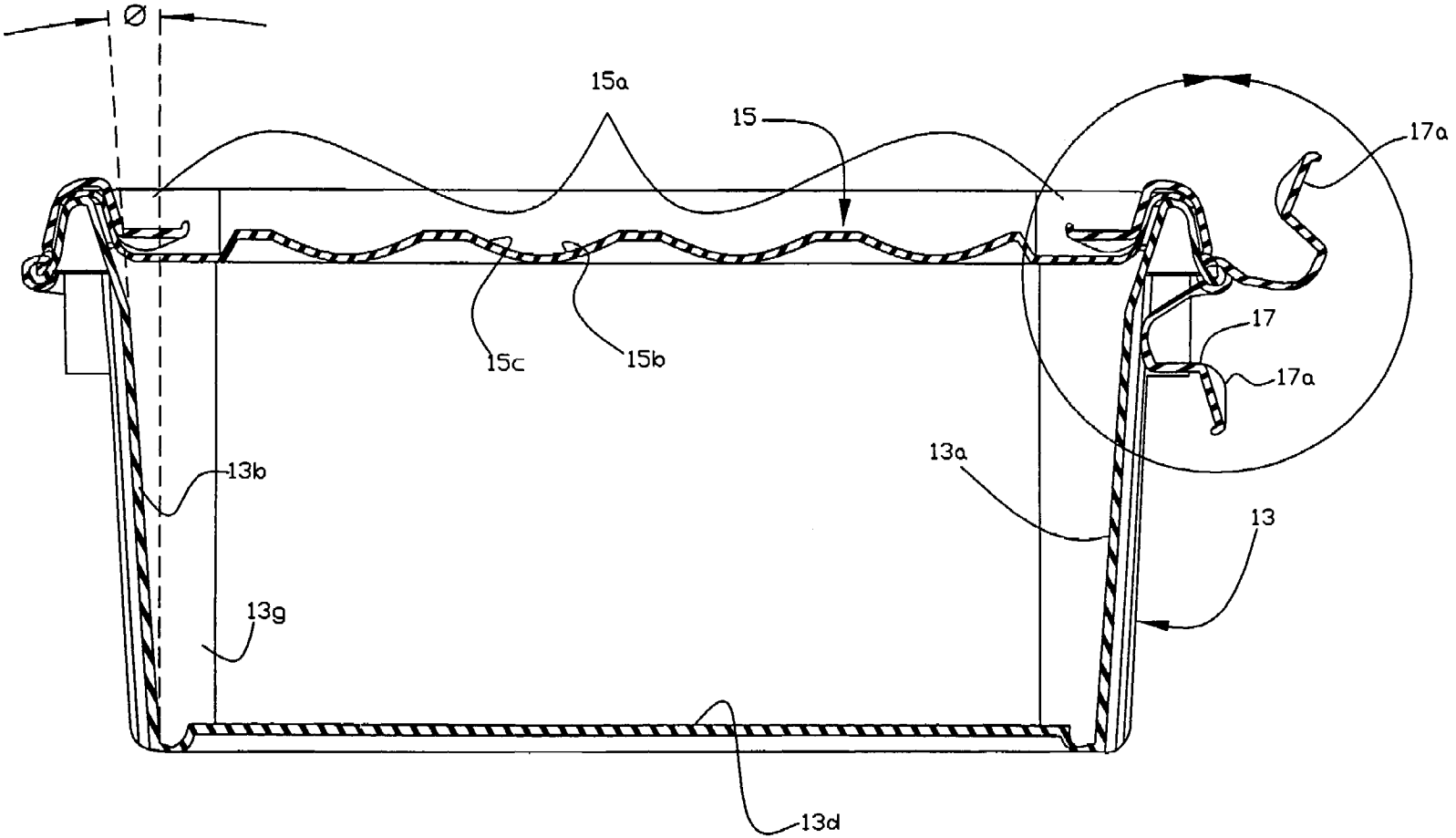
FIG. 4 is a cross-sectional view of the vessel and lid in an assembled condition showing the latch in an open and closed position.
Figure 5:
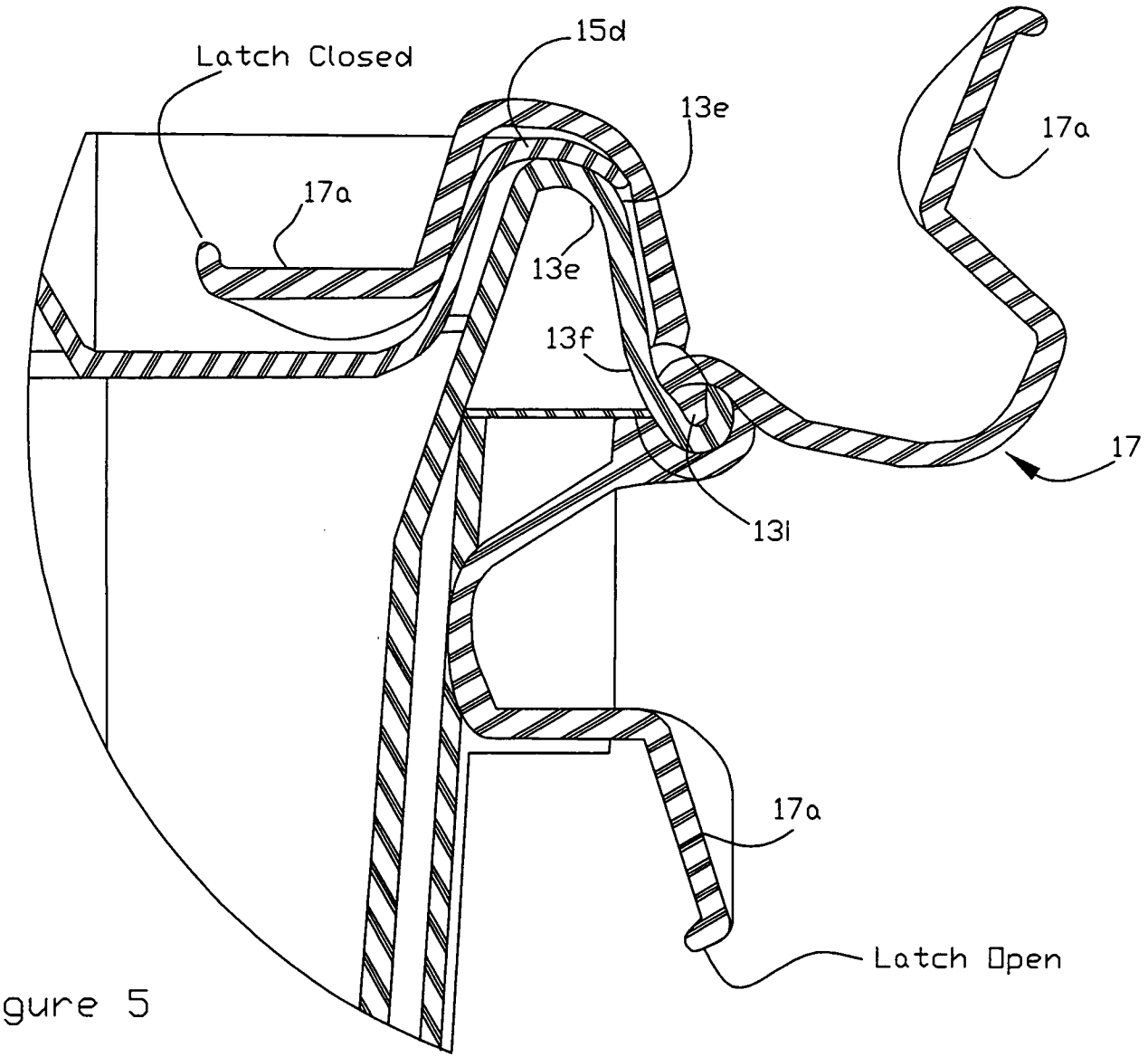
FIG. 5 is a broken away view of the latch arrangement of FIG. 4.

Referring now to FIGS. 4 and 5, the latch 17 is in the form of an inverted U (in the closed position) with a laterally projecting leg 17*a* which fits over the vessel's rim 13*e* and the lid's peripheral section 15*d*, when the lid is closed, as is shown. The latch 17 is hinged to the rim 13 via axles 13*i* as pointed out previously.

As discussed earlier, I have found that conventional household shelving depths, particularly those in cabinets or in standard board sizes to be mounted by the customer, range in increments of about 2" from an 8" depth to at least a 20" depth. While I have tailored the present method to those depths it is to be understood that the invention is not limited to those specific depths. Three groups of containers have been chosen to illustrate the invention, i.e., containers having footprints of a) 11.50"×9.50" (container group 12), b) 13.50"×9.50" (container group 14); and c) 15.50"×11.50" (container group 16) for standard shelving depths of 12", 14" and 16", respectively. See FIGS. 6-12. The length of the container is correlated to the shelf depth while accommodating the closure of a cabinet door or a lateral nailing flange at the back of a cabinet. It should be noted that the length of the container in each group is preferably less than the associated shelving depth by about 0" to 1" and most preferably about ¼" to ½". As is illustrated by the chart of FIG. 13 I have found it desirable to provide a ½" clearance.

Figure 6:
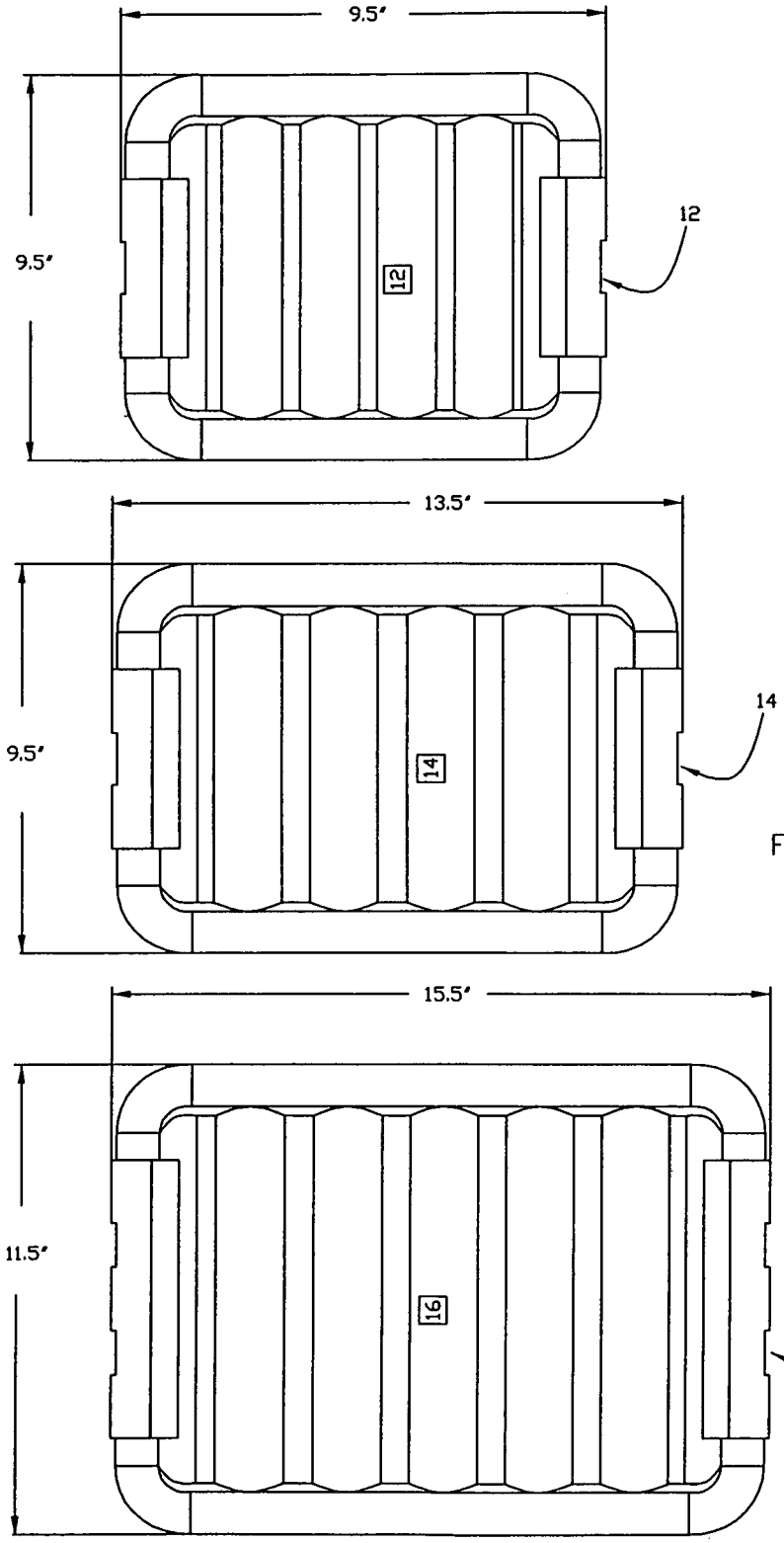
FIG. 6 is a top plan view of the containers of three selected individual groups illustrating the basic footprints of each group.
Figure 7:
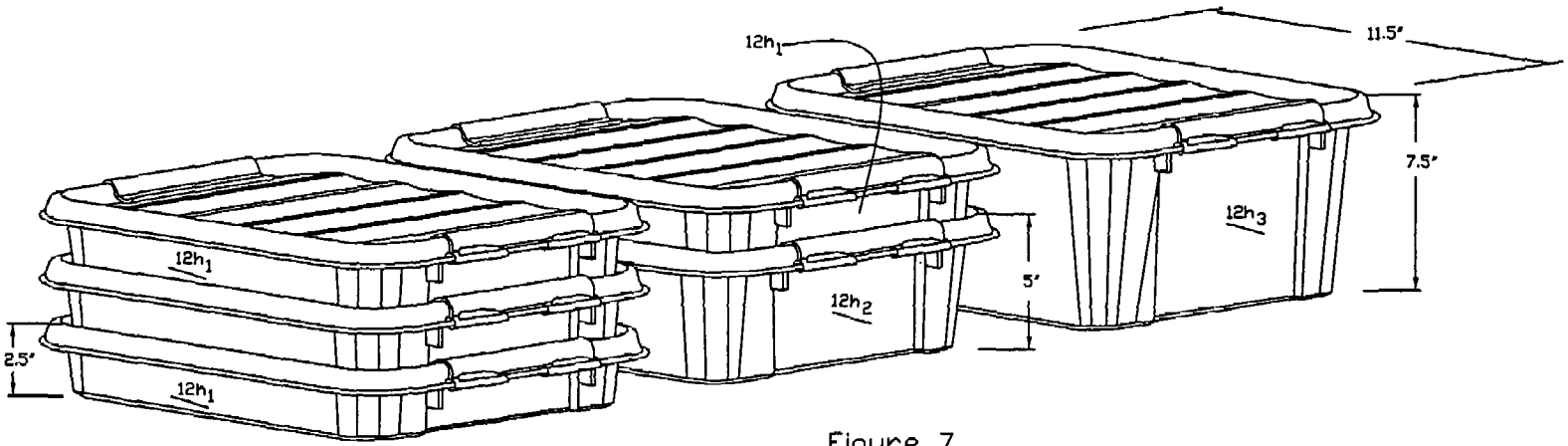
FIG. 7 is a perspective view of five containers of one of the groups showing several of the containers in a stacked condition providing approximately the same overall height.
Figure 8:
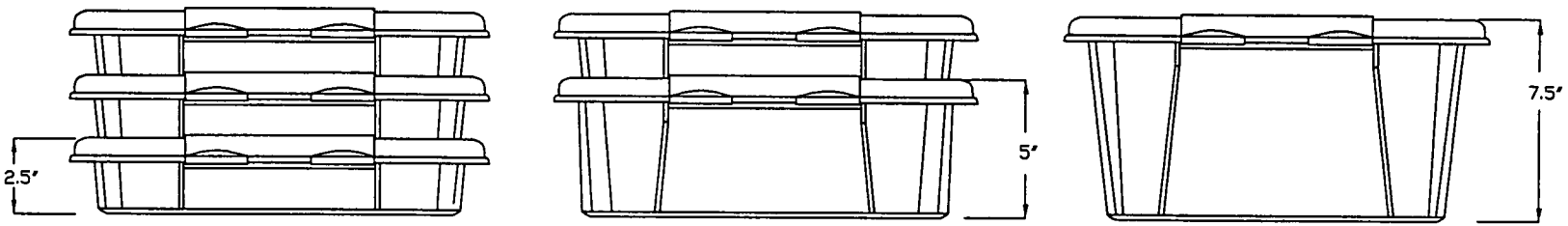
FIG. 8 is a front elevational view of the containers of FIG. 7.
Figure 9:
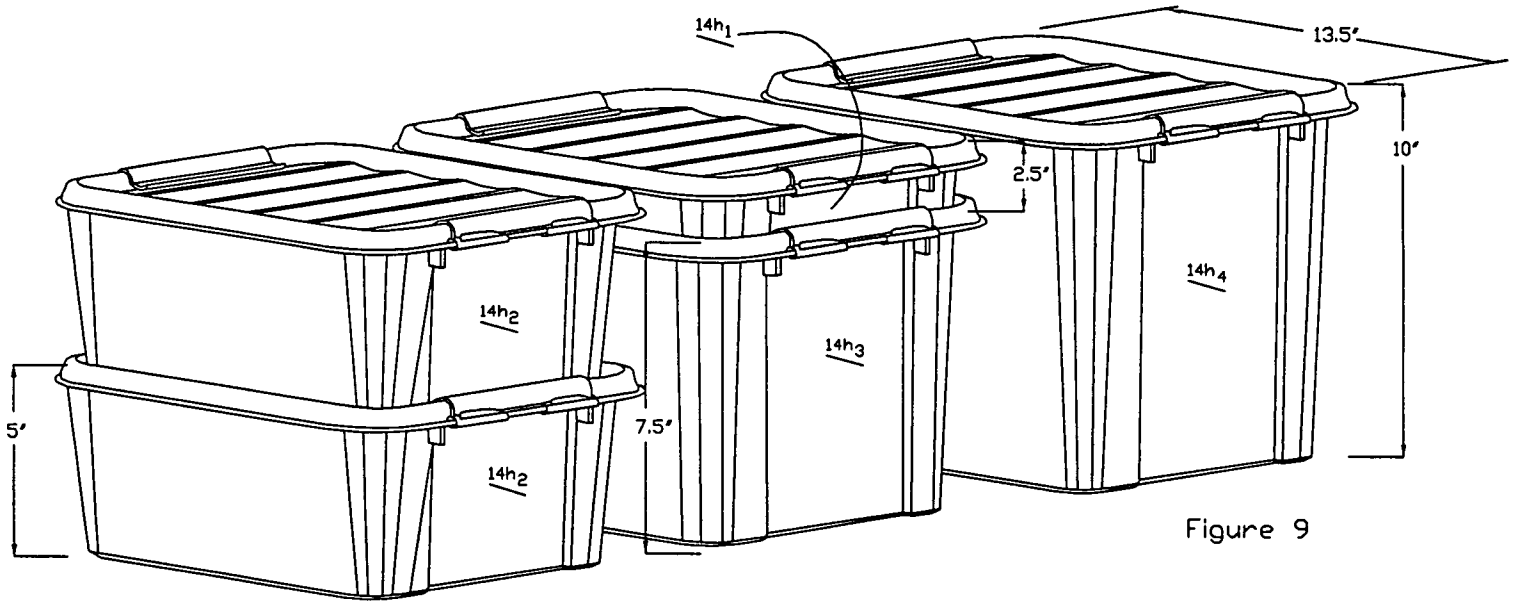
FIG. 9 is a perspective view of five containers of another group.
Figure 10:
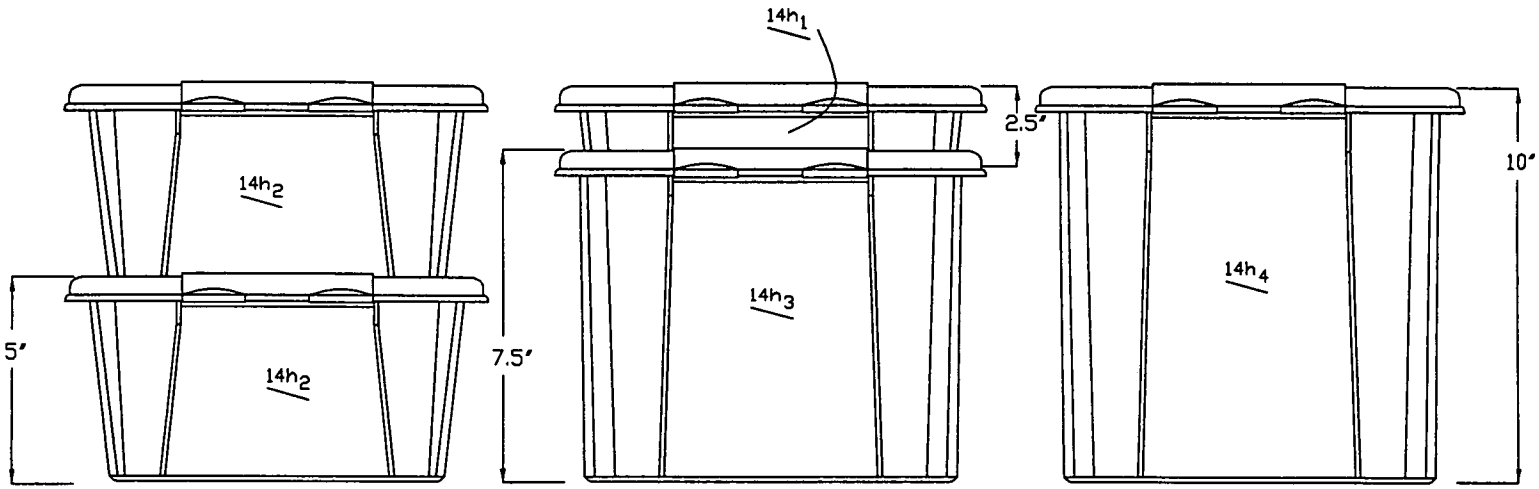
FIG. 10 is a front elevational view of the containers of FIG. 9.

Referring now to FIGS. 6 and 7, group 12, for illustrative purposes only, includes four containers $\mathbf{12}h_1$, one container $\mathbf{12}h_2$ and one container $\mathbf{12}h_3$ having heights of 2½", 5" and 7½", respectively, as shown. The height of the shortest container is preferably one-half the height of the next taller container. It should be noted that the overall height of stacked containers will be slightly less than the sum of their individual heights due to the depressed central lid sections 15*a*.

Referring to FIGS. 9 and 10, group 14, again for illustrative purposes, includes one container $\mathbf{14}h_1$, two containers $\mathbf{14}h_2$, one container $\mathbf{14}h_3$ and one container $\mathbf{14}h_4$, having heights of 2½", 5", 7½" and 10", respectively.

Figure 11:
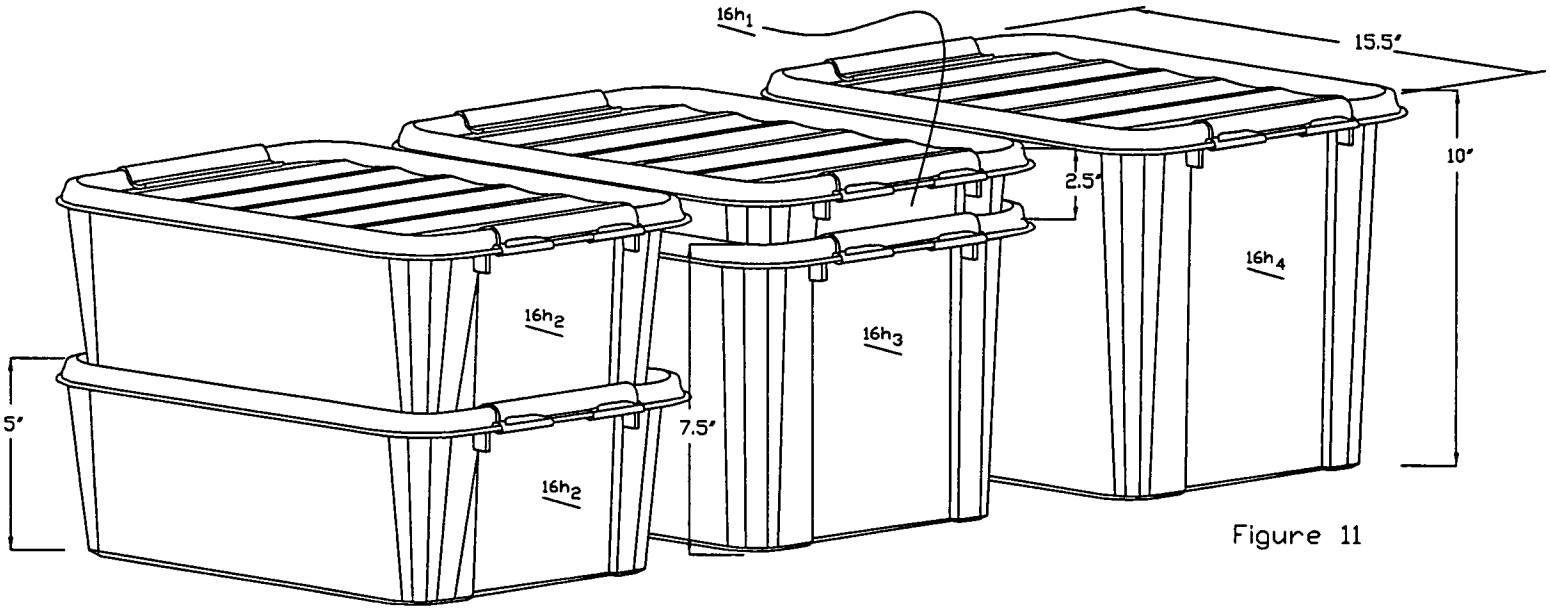
FIG. 11 is a perspective view of five containers of a third group.
Figure 12:
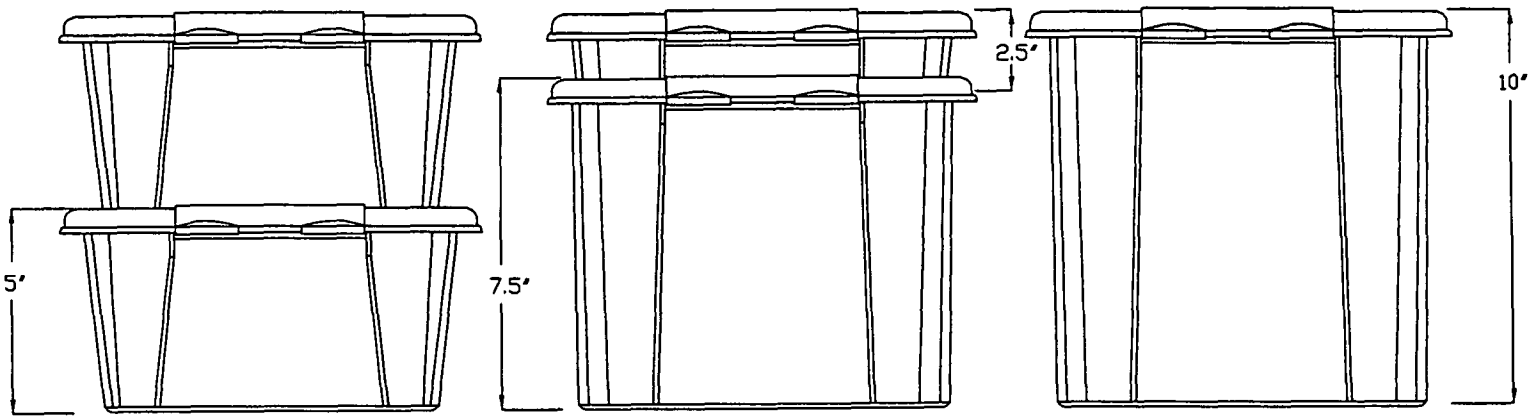
FIG. 12 is a front elevational view of the containers of FIG. 11.

Referring to FIGS. 11 and 12, group 16 (like group 14), for illustrative purposes, includes one container $\mathbf{16}h_3$, two containers $\mathbf{16}h_2$, one container $\mathbf{16}h_3$, and one container $\mathbf{16}h_4$ having heights of 2½", 5", 7½" and 10", respectively. The specific dimensions given in FIGS. 6-13 are by way of example only.

FIG. 13 is a chart correlating seven container groups, i.e., Nos. 8-20, with standard shelving depths, i.e., 8"-20", along with available container heights. This information is preferably made available to prospective purchasers, via a point of sale chart or specification sheets, to allow them to select those container lengths which best match their available shelving depths. The chart also provides the container heights which are available for each container group thereby allowing a customer to select those container heights which best fit their available shelf height spacing. The standard widths for each group of containers reduces the number of necessary lids while enabling a consumer to select the number of containers in a particular group to optimize the distance along the shelf or shelves. The darkened spaces illustrate a family of 24 containers within the seven groups which I have found particularly useful to the consumer.

There has thus been described novel merchandising method to aid consumers in maximizing the use of their available shelf storage space. Modifications of the method or system will undoubtedly occur to those skilled in the art without involving a departure from the spirit and scope of my invention as defined by the appended claims.

What is claimed is:

1. A method of merchandising a modular home storage vessel organizing system, the vessels being configured for use on shelves having at least three different depths, each vessel having front, back and opposed side walls extending upwardly from a bottom wall to an open top, a length, width and height comprising:

a) providing at least three groups of vessels with the vessels of each group having a uniform length which correlates with one of the shelving depths, a uniform width, and a plurality of different heights, the uniform length of the containers of each group being different from the uniform length of the containers of each other group of said at least three groups of vessels, wherein the vessel heights in each group are graduated so that the height of a shorter vessel will be equal to one half the height of the next taller vessel, and wherein the vessels in each group have heights of at least h.sub.1, h.sub.2 and h.sub.3, where 2.times.h.sub.1=h.sub.2 and h.sub.1+h.sub.2=h.sub.3; and b) displaying the groups of vessels to prospective purchasers.

2. The method of claim 1 further including providing a chart accessible to prospective purchasers, the chart correlating each of the groups with its associated shelving depth.

3. The method of claim 1 wherein the vessels of each group are provided with a unique identifying symbol to enable a prospective purchaser to identify all of the vessels in each group.

4. The method of claim 3 further including removable lids associated with each group, each lid associated with each group of vessels bearing the same symbol as the vessels.

5. The method of claim 4 wherein the symbol is a number.

6. The method of claim 4 wherein said at least three shelving depths are nominally 12", 14" and 16".

7. The method of claim 4 wherein said at least three shelving depths comprise five depths.

8. The method of claim 7 wherein the five shelving depths are nominally 8", 10", 12", 14" and 16".

9. The method of claim 4 wherein said at least three shelving depths comprise seven shelving depths.

10. The method of claim 9 wherein said seven shelving depths are 8", 10", 12", 14", 16", 18", and 20".

11. The method of claim 6 wherein the heights of the vessels in each group are about 2.5", 5" and 7.5".

12. The method of claim 1 wherein the length of the container in each group is less than the associated shelving depth by about 0" to 1".

13. The method of claim 12 wherein the length of the containers in each group is less than the associated shelving depth by about ¼" to ½".

* * * * *